US007549896B2

(12) United States Patent
Zhang et al.

(10) Patent No.: US 7,549,896 B2
(45) Date of Patent: Jun. 23, 2009

(54) LOW PROFILE RECEPTACLE CONNECTOR STRADDLE-MOUNTED ON THE PCB

(75) Inventors: Han-Ming Zhang, ShenZhen (CN); Tsuneki Watanabe, Yokohama (JP); Jian-Ping Xiao, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,782

(22) Filed: Jun. 12, 2008

(65) Prior Publication Data

US 2008/0311793 A1 Dec. 18, 2008

(51) Int. Cl.
*H01R 13/648* (2006.01)

(52) U.S. Cl. ..... 439/607

(58) Field of Classification Search ..... 439/607, 439/83

See application file for complete search history.

(56) References Cited

U.S. PATENT DOCUMENTS 5,718,605 A * 2/1998 Morikawa et al. ..... 439/607
6,217,378 B1 * 4/2001 Wu ..... 439/607
6,478,630 B1 * 11/2002 Hsu ..... 439/607
6,722,919 B2 * 4/2004 Lin ..... 439/607
6,764,339 B2 * 7/2004 Kubo ..... 439/607
6,902,432 B2 6/2005 Morikawa et al.
7,252,549 B2 8/2007 Nishio et al.
2002/0151217 A1 * 10/2002 Ivey et al. ..... 439/607

* cited by examiner

*Primary Examiner*—Tho D Ta
(74) *Attorney, Agent, or Firm*—Wei Te Chung

(57) ABSTRACT

A receptacle connector (100) includes a metal shield (3) having the cover (31) and an opposite base (32). The cover (31) includes a pair of top lateral wings (312). The base includes a pair of bottom lateral wings (322) for mating with the respective top lateral wings (312). The top lateral wing (312) defines a first portion of a whole lateral wing board, while the bottom lateral wing (322) defines a second portion adapted to contribute towards completing the whole lateral wing board. Thus, the metal shield (3) is integrated by the cover (31) and the base (32), each of which is molded by a single sheet.

10 Claims, 3 Drawing Sheets

LOW PROFILE RECEPTACLE CONNECTOR STRADDLE-MOUNTED ON THE PCB

BACKGROUND OF THE INVENTION

1. Field of the Invention

The present invention relates to an electrical connector, and more particularly to a low profile receptacle connector straddle-mounded into a cutout of a substrate. The connector includes a metal shell featured with supporting tabs securely disposed onto the substrate.

2. Description of the Prior Art

U.S. Pat. No. 7,252,549 issued to Mitsumi Electric Co., Ltd., on Aug. 7, 2007 discloses 'A connector includes a receptacle 1 to be mounted on a substrate 11 and a plug 5 adapted to be connected to the receptacle 1. The receptacle 1 has a shield case 2 provided with connection terminals 31 therein, and the plug 5 has a shield case 6 provided with connection terminals 71 therein. The shield case 6 of the plug 5 is adapted to be inserted into the shield case 2 of the receptacle 1 when the plug 5 is connected to the receptacle 1, at which the connection terminals 71 of the plug 5 are electrically connected to the connection terminals 31 of the receptacle 1. A tongue portion 23 is provided on a bottom surface of the shield case 2 of the receptacle 1 and a recess 63 is formed on a bottom surface 61 of the shield case 6 of the plug 5 so that the tongue portion 23 is fitted into the recess 63 when the plug 5 is connected to the receptacle 1, which serve as an erroneous insertion preventing and guiding mechanism.

U.S. Pat. No. 6,902,432 issued to Yazaki Corporation on Jun. 7, 2005 discloses 'A USB connector includes a jack and a plug. The jack includes a shield shell, having jack terminals therein. The plug includes a shield case, having plug terminals to be electrically connected to the jack terminals, and fitted into the shield shell. The shield shell has a mating portion. The shield case has a latching portion which engages with the mating portion when the plug is inserted into the jack.

As we know, the shield case of the receptacle connector disclosed in the U.S. Pat. No. 7,252,549 is pressed by a whole metal sheet, the complex shape needs several processing to manufacture. A block extends form the end portion of the housing of the connector, the bilateral of the block effecting by the asymmetric force result in rocking of the housing. The through-hole mounting of the shield case is adverse to the minimization of the connector.

SUMMARY OF THE INVENTION

Accordingly, an aspect of the present invention is to provide a reliable receptacle connector. The present invention referring to a receptacle connector comprise: a dielectric housing forming recesses therein, a plurality of terminals receiving in the recesses, and a metal shield enclosing the dielectric housing. The metal shield contains the cover and the base. A pair of fingers extending from the cover and a pair of arms extending from the base hold the rear end of the housing. The arms and the fingers are in pairs and arranged in symmetrical making the dielectric housing in perfect balance.

Another aspect of the present invention is to provide a receptacle connector whose metal shield is easy to manufacture. The metal shield contains the cover and an opposite base. The cover has a top wall and a pair of top lateral walls standing at bilateral of the top wall. There are top bottom wings extending from the end of the lateral walls. The base contains a bottom wall and a pair of curve portions adjoining the bottom wall, and a pair of bottom lateral wings extending from the end of the curve portions. Either the main body of the cover or the base, can be shaped in one press processing, this processing increase the productivity of the metal shield and make the assembling of the receptacle connector more convenient.

The third aspect of the present invention is to provide a low height receptacle connector. The metal shield contains the cover and an opposite base. The cover has a top wall and a pair of top lateral walls standing at bilateral of the top wall. There are top lateral wings extending from the end of the lateral walls. The base contains a bottom wall and a pair of curve portions adjoining the bottom wall, and a pair of bottom lateral wings extending from the end of the curve portions. A substrate is necessary for the stable of the receptacle connector, the top and bottom lateral wings solder to the substrate. The substrate forms an opening where the metal shield sinks into. Because the height of the substrate coincides with the height of the metal shield, the height of the receptacle connector lower than the metal shield that don't sank into the substrate.

DESCRIPTION OF PREFERRED EMBODIMENT OF THE INVENTION

Reference will now be made to the drawings to describe the present invention in detail.

Figure 1:
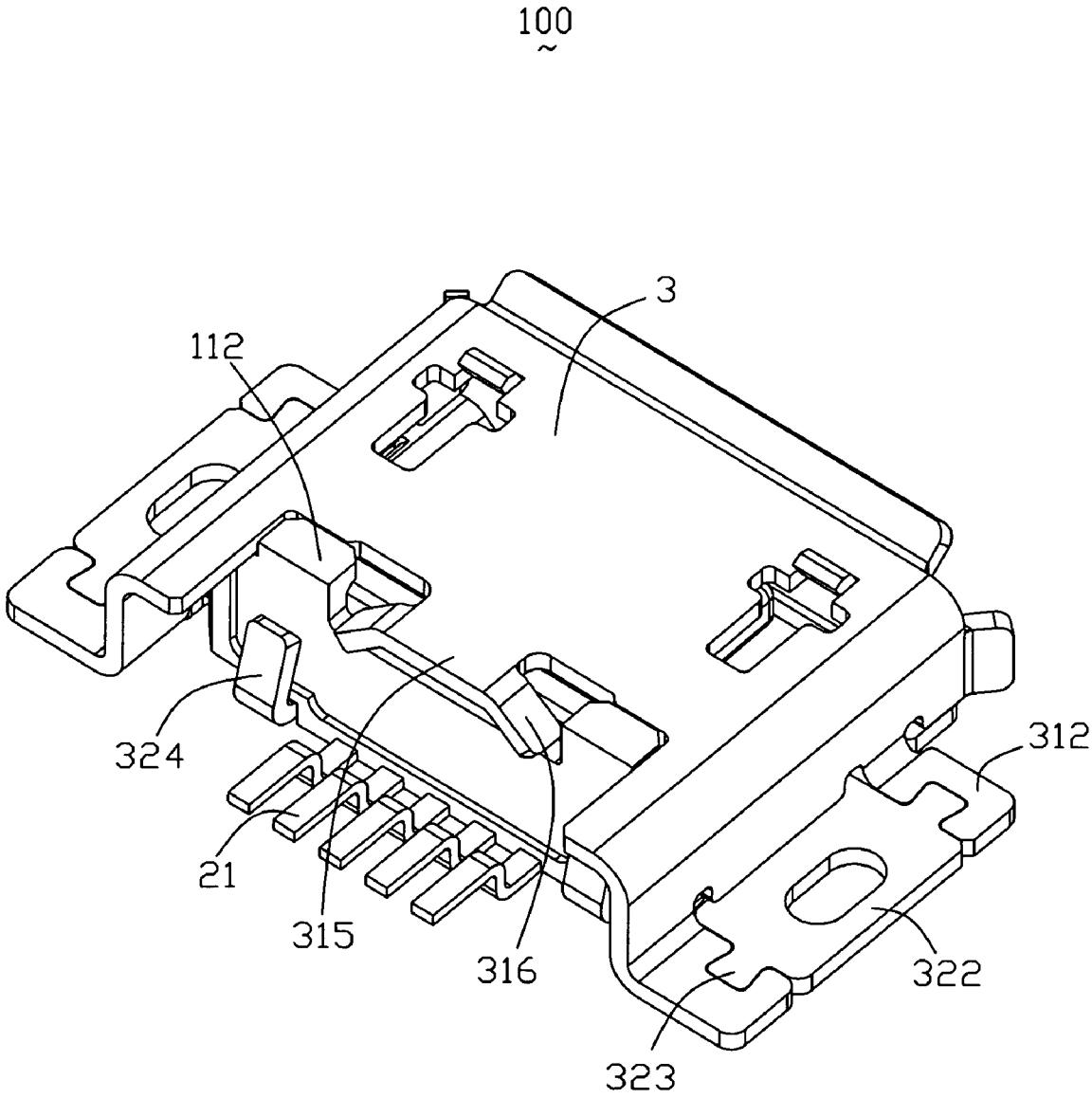
FIG. 1 is a perspective view of an electrical connector in accordance with a preferred embodiment of the present invention.

Referring to FIG. 1, depicts an embodiment of a receptacle connector 100, the connector can be installed on a substrate for example a print circuit board (PCB), and the like.

A receptacle connector 100 includes: a dielectric housing 1 forming recesses 115/121 therein, a plurality of terminals 2 received in the recesses 114/121, and a metal shield 3 enclosing the dielectric housing 1.

Figure 2:
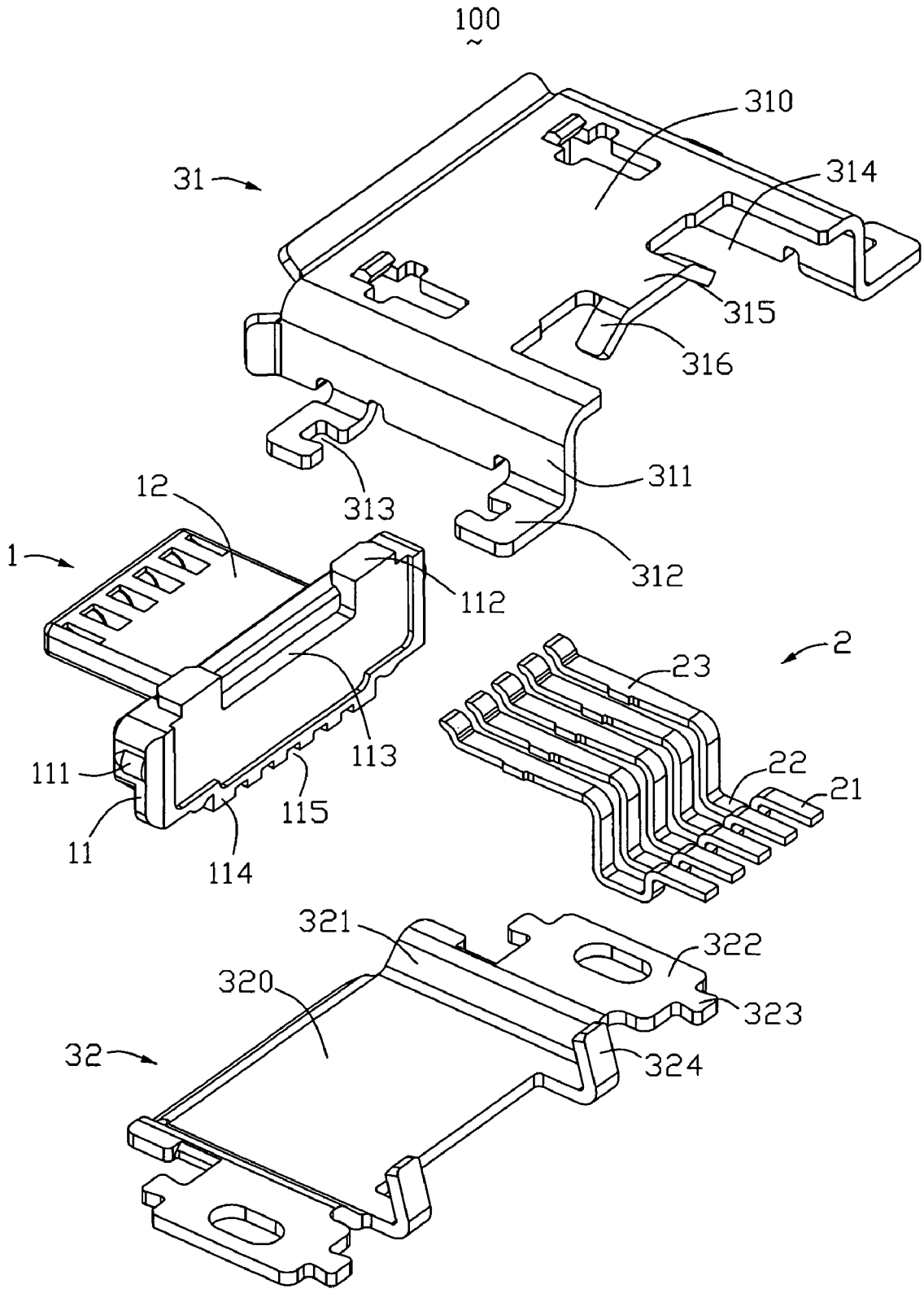
FIG. 2 is exploded view of the present invention of FIG. 1.
Figure 3:
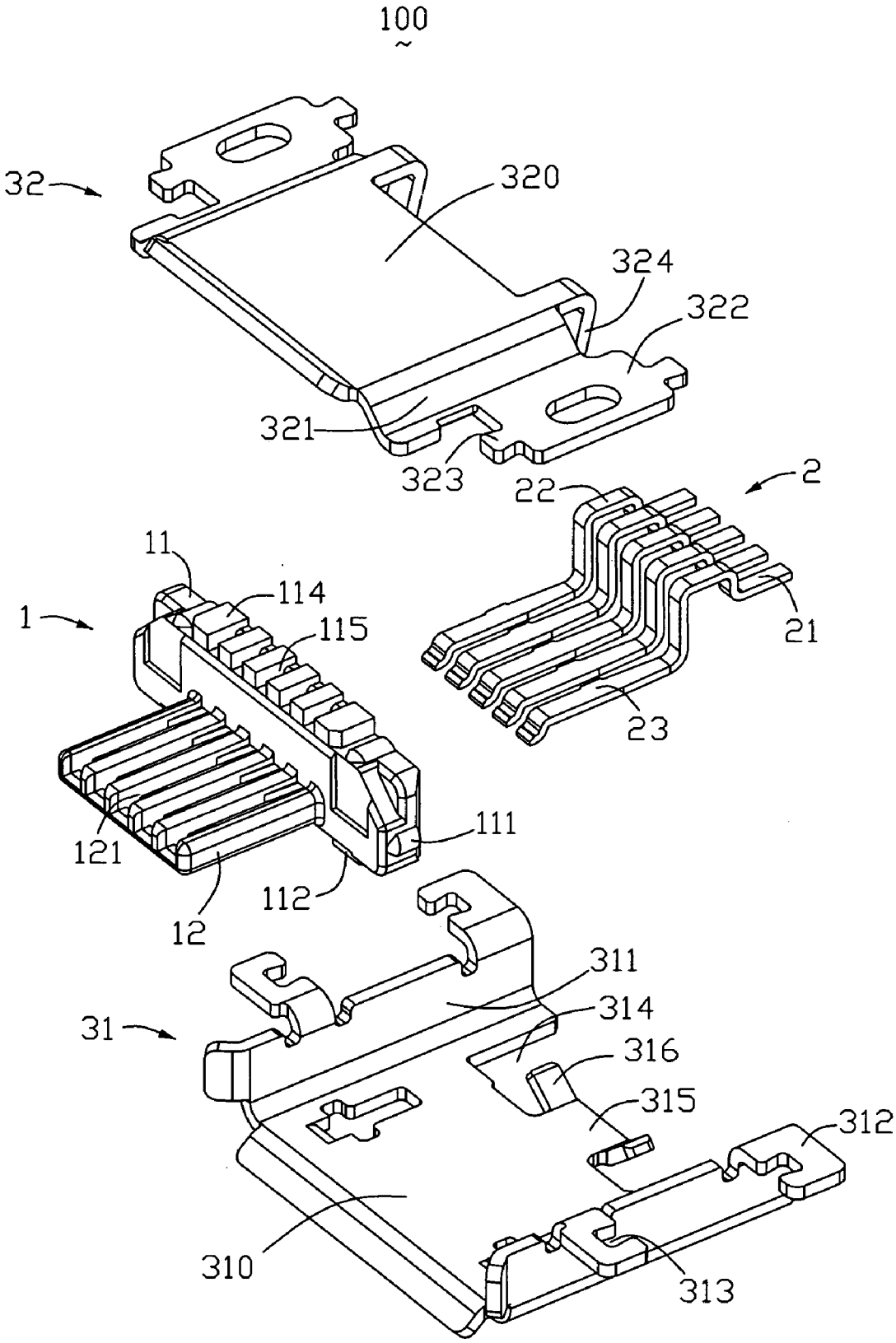
FIG. 3 is another exploded view the present invention of FIG. 1.

Elements of receptacle connector 100 are shown clearly in FIG. 2 and FIG. 3. The dielectric housing 1 contains a base portion 11 and a tongue portion 12 extending from the base portion 11. The base portion 11 assumes rectangular parallelepiped, the left and right lateral face of the base portion 11 form a pair of cylinder cams 111, two blocks 112 project from the top face of the base portion 11, a corner 113 is located between the blocks 112 defining a slot, a pair of curbs 114 is shaped near both side of the bottom face. Several first recesses 115 are defined between curbs 114. The tongue portion 12 extends from the front face of the base portion 11. Corresponding to the first recesses 115, there is a plurality of second recesses 121 located in the tongue portion 12.

Each terminal 2 has soldering pad 21, a connecting portion 22 adjoining the soldering pad 21, and the contact portion 23 at the side opposite to soldering pad 21. the contact portion 23 is received in the second recesses 121, the connecting portion 22 is mounted in the first recesses 111, and the soldering pad 21 can attach to the substrate, for example a print circuit board, and the like.

The metal shield 3 has two parts, the cover 31 and the base 32 opposite to the cover 31. Both of the cover 31 and the base 32 are pressed by a metal sheet. The cover 31 has a top wall 310 and a pair of top lateral walls 311 vertically standing at bilateral of the top wall 310. There are top lateral wings 312 which parallel with the top wall 310 extending from the end of the lateral walls 311. Each top lateral wing 312 has an internal lateral border 313 located therein. A gap 314 is mounted on the rear end of the top wall 310, a holding portion 315 is located in the middle of the gap 314. The holding portion 315 contains two fingers 316, the fingers 316 and the gap 314 form a space receiving the blocks 112 therein. The base 32 contains a bottom wall 320 and a pair of curve portions 321 adjoining the bottom wall 320, and a pair of bottom lateral wing 322 extending from the end of the curve portions 321. Each bottom lateral wing 322 has a lateral tab 323 having an external border corresponding to the internal lateral border 313. And the top lateral wing 312 and the bottom lateral wing 322 can match together, the position of the mating face is in the middle of the top wall 310 and the bottom 320. The bottom wall 320 has two arms 324 in the rear end of the bottom wall 320.

The blocks 112 of the dielectric housing is received in the space formed by edge of the gap 314 and the fingers 316 of the holding portion 315, and the fingers 316 of the holding portion 315 correspondingly fixed by the slot defined by the blocks 112 and the corner 113 therebetween. The inside face of the arms 324 lean against the outside face of the curbs 114, and the end of the arms 324 lean against the rear face of the dielectric housing 1, the cylinder cams 116 interfere in the inside face of the lateral wall 311. The arms 324 and the fingers 316 are in pairs and arranged in symmetrical making the dielectric housing 1 in perfect balance.

The metal shield 3 contain the cover 31 and the base 32, both the cover 31 and bottom 32 are shaped in one press processing, the processing can increase the productivity of the metal shield 3, and make the assembling more convenient.

The metal shield 3 contains the cover 31 and an opposite base 32. The cover 31 contains a top wall 310 and a pair of top lateral walls 311 vertically standing at bilateral of the top wall 310. There are top lateral wings 312 which parallel with the top wall 310 extending from the end of the lateral walls 311. Each top lateral wing 312 defines a recess 313 having an internal lateral border thereof. The base 32 contains a bottom wall 320 and a curve portion 321 adjoining the bottom wall 320, and a pair of bottom lateral wing 322 extending from the end of the curve portion 321. Each bottom lateral wing 322 has a lateral tab 323 having an external border corresponding to the internal lateral border of the recess 313. The lateral tab 323 is enclosed by the internal lateral border so as to be embedded within the recess As shown in FIG. 1, the top lateral wings 312 defines a first portion of a whole lateral wing board, while the bottom lateral wing defines a second portion adapted to contribute towards completing the whole lateral wing board. Thus, the metal shield 3 is integrated by the cover and the base, each of which is molded by a single sheet. This facilities the manufacture process of the whole metal shield, and causes no damage of the metal shield 3 after repeated molding of the top or base compared with the prior art of molding a whole metal shield. A substrate is necessary for the stable of the receptacle connector, the lateral tab 323 insert into the internal lateral border 313, and the top and bottom lateral wings 312322 solder to the substrate. The substrate forms an opening where the curve portions 321 and the bottom wall 320 sink into. Because the height of the substrate coincides with the height of the metal shield 3, a height of substrate thickness is diminished to the whole connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A receptacle connector comprising:

a dielectric housing including a base portion and a tongue portion extending from the base portion, and a plurality of recesses formed in the dielectric housing;

a plurality of terminals received in the recesses; and a metal shield enclosing the dielectric housing; and the metal shield including a cover and an opposite base, the cover including a top wall and a pair of top lateral wings located at opposite sides of the top wall, the base including a bottom wall and a pair of bottom lateral wings, the bottom lateral wings located at opposite sides of the bottom base wall for mating with the top lateral wings; the top lateral wing defining a first portion of a whole lateral wing board, the bottom lateral wing defining a second portion adapted to contribute towards completing the whole lateral wing board;

wherein one of the first portion and second portion having a recess defining an internal lateral border, the other one of the first portion and the second portion formed with a lateral tab enclosed by the internal lateral border so as to be embedded within the recess.

2. The receptacle connector of claim 1, wherein the cover includes a downwardly-extending holding portion abutting against an engaging wall of the base portion for holding the cover onto the dielectric housing.

3. The receptacle connector of claim 2, wherein the base portion defines a slot having the engaging wall for the holding portion.

4. A shielded receptacle connector, comprising:

a metal shield configured by a base and a cover securely attached thereto, and jointly forming supporting tabs extending traversally from a middle portion of a joint portion between the base and the cover;

an insulative housing assembled with electrical contacts disposed within the metal shield;

wherein the supporting tabs can be soldered to a substrate;

wherein the supporting tabs of cover define first wings, and the supporting tabs of the base define second wings, the first and second wings match with each other;

wherein the first wings rivet with the second wings;

wherein one of the first portion and second portion having a recess defining an internal lateral border, the other one of the first portion and the second portion formed with a lateral tab enclosed by the internal lateral border so as to be embedded within the recess.

5. An electrical connector assembly comprising:

an insulative housing;

a plurality of contacts disposed in the housing;

a metallic shell cooperating with the housing to define a mating port into which the contacts extend; said shell including a cover and a base, said cover covering three sides of the mating port while the base covering only one side mating port; wherein said shell includes a pair of mounting pads on two opposite lateral sides for being vertically seated upon a printed circuit board, and each of said mounting pads includes a first engagement part of the cover and a second engagement part of the base interengaged with each other;

wherein said first engagement part includes two halves with said second engagement part therebetween.

6. The electrical connector assembly as claimed in claim 5, wherein said mounting pad is located at a level between opposite upper and lower faces of said mating port.

7. The electrical connector assembly as claimed in claim 5, wherein interengagement between said first engagement part and the second engagement part occurs horizontally.

8. The electrical connector assembly as claimed in claim 5, wherein one of said first engagement part and said second engagement part defines a through hole.

9. The electrical connector assembly as claimed in claim 5, wherein said second engagement part defines a through hole therein.

10. The electrical connector assembly as claimed in claim 9, wherein said base includes retention devices abutting against the housing.

* * * * *